US008613495B2

(12) United States Patent
Kaneko et al.

(10) Patent No.: US 8,613,495 B2
(45) Date of Patent: Dec. 24, 2013

(54) LIQUID EJECTION HEAD

(75) Inventors: Toshiaki Kaneko, Tokyo (JP); Shozo Hattori, Tokyo (JP); Masashi Miyagawa, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/366,527

(22) Filed: Feb. 6, 2012

(65) Prior Publication Data

US 2012/0236077 A1 Sep. 20, 2012

(30) Foreign Application Priority Data

Mar. 18, 2011 (JP) ..... 2011-060935

(51) Int. Cl.
*B41J 2/135* (2006.01)

(52) U.S. Cl.
USPC ..... 347/44

(58) Field of Classification Search
USPC ..... 347/44
See application file for complete search history.

(56) References Cited

U.S. PATENT DOCUMENTS 6,155,677 A * 12/2000 Kitani et al. ..... 347/65
6,257,703 B1 7/2001 Hirosawa et al.
2011/0279547 A1* 11/2011 Hattori et al. ..... 347/54

FOREIGN PATENT DOCUMENTS

JP 2007-276156 * 10/2007 ..... B41J 2/50
JP 2007-276156 A 10/2007

OTHER PUBLICATIONS

U.S. Appl. No. 13/398,225, filed Feb. 16, 2012, Hirotaka Miyazaki, Toshiaki Kaneko.

* cited by examiner

*Primary Examiner* — Matthew Luu
*Assistant Examiner* — Michael Konczal
(74) *Attorney, Agent, or Firm* — Fitzpatrick, Cella, Harper & Scinto

(57) ABSTRACT

A liquid ejection head including an ejection device substrate having a substrate provided with an energy-generating element that generates energy for ejecting a liquid, a liquid supply member that supplies the liquid to the ejection device substrate, and a support member that is provided between and joined to the ejection device substrate and the liquid supply member. The support member has at least two liquid supply flow paths that are through-holes extending through the support member and has a projected or depressed portion at its joint surface with respect to the liquid supply member. A spacing between two adjoining liquid supply flow paths at the joint surface with respect to the liquid supply member is larger than a spacing between the adjoining two liquid supply flow paths at a joint surface of the support member with respect to the ejection device substrate.

9 Claims, 5 Drawing Sheets

LIQUID EJECTION HEAD

BACKGROUND OF THE INVENTION

1. Field of the Invention

The present invention relates to a liquid ejection head such as an ink jet recording head from which an ink is ejected on a recording medium to conduct recording.

2. Description of the Related Art

Examples of use of a liquid ejection head for ejecting a liquid include an ink jet recording head used in an ink jet recording system in which an ink is ejected on a recording medium to conduct recording. As the ink jet recording head (recording head), a recording head having an ejection device substrate and an ink supply path forming member (ink supply member) that supplies an ink to the ejection device substrate is known. Incidentally, the ejection device substrate is provided with at least a plurality of ejection orifices for ejecting an ink and an energy-generating element for applying ejection energy to the ink within a flow path. A silicon substrate is generally used as a substrate used in the ejection device substrate. The ink supply member is made of a plastic or the like.

Such a recording head has heretofore involved the following problem. A stress against a joint interface between the ejection device substrate provided with the energy-generating element for ejecting a liquid from the ejection orifice and the ink supply member for storing the liquid and supplying the liquid to the ejection device substrate has been increased by a difference in coefficient of linear expansion between the substrate and the member, so that warpage or distortion of the ejection device substrate may have occurred in some cases.

In such a case, a thermal stress may have been generated at the joint interface between the ejection device substrate and the ink supply member by temperature rise during recording in some cases, and deformation of the ejection device substrate may have been caused in some cases to affect a recorded image.

As a method for solving the above-described phenomenon, U.S. Pat. No. 6,257,703 describes such a construction that a support member having a coefficient of linear expansion comparable to that of the silicon of the ejection device substrate is caused to intervene between the ejection device substrate and the ink supply member. In addition, Japanese Patent Application Laid-Open No. 2007-276156 discloses a method for integrally forming a support member having a coefficient of linear expansion comparable to that of the silicon of the ejection device substrate with the ink support member.

Such a recording head having the support member between the ejection device substrate and the ink supply member as described above has caused leakage of an ink toward the outside of a flow path unless the ejection device substrate or the ink supply member has been surely joined to the support member. In particular, when the support member has at least two ink supply flow paths, there has been a possibility that two or more inks may mix with each other to affect a recorded image when this joint is not surely conducted to leak the ink to the outside of the flow paths.

Since the joint between the substrate and the support member easily affects the recorded image, they are generally joined by a mount technology attaching great importance to accuracy to guarantee liquid sealability.

On the other hand, in the joint between the support member and the ink supply member, a joint method by simple integral molding is favorable because the influence on the recorded image is slight. However, a material used in the ink supply member and a material used in the support member are different in properties required, so that a good joint state may have not been achieved in some cases when the support member has been formed integrally with the ink support member. In addition, peeling may have occurred between the support member and the ink supply member in some cases, and so there has been a possibility that the liquid sealability may be lowered.

A method of improving joining ability by providing a depressed and projected profile on a joint surface between the support member and the ink supply member is considered as a method for improving the liquid sealability. However, it is required to produce more silicon substrates from one wafer from the viewpoints of energy saving and cost lowering, and researches for improving the number of substrates producible from one wafer are advanced. In the process thereof, as the width of the substrate is more narrowed, a joint region between the substrate and the support member and a joint region between the support member and the ink supply member also tend to be narrowed. With the narrowing of the joint region between the support member and the ink supply member, it is difficult to provide the depressed and projected profile on the joint surface between the support member and the ink supply member by molding.

Accordingly, there is a demand for ensuring a region capable of providing the depressed and projected profile on the joint surface between the support member and the ink supply member even when the substrate narrowing technology is advanced to guarantee liquid sealability in integral molding of the support member and the ink supply member.

The present invention can solve the problems in the prior art. The present invention can provide a liquid ejection head having good liquid sealability, such as an ink jet recording head, in which a support member supporting an ejection device substrate and an ink supply member for supplying an ink to the ejection device substrate are joined with extremely good compatibility, even when the substrate narrowing technology is advanced.

SUMMARY OF THE INVENTION

According to the present invention, there is provided a liquid ejection head comprising an ejection device substrate having a substrate provided with an energy-generating element that generates energy for ejecting a liquid, a liquid supply member that supplies the liquid to the ejection device substrate, and a support member that is provided between the ejection device substrate and the liquid supply member and joined to the ejection device substrate and to the liquid supply member, wherein the support member has at least two liquid supply flow paths that are through-holes extending through the support member and has a projected portion or a depressed portion at a joint surface of the support member with respect to the liquid supply member, and wherein a spacing between two liquid supply flow paths adjoining each other at the joint surface of the support member with respect to the liquid supply member is larger than a spacing between the two liquid supply flow paths adjoining each other at a joint surface of the support member with respect to the ejection device substrate.

Further features of the present invention will become apparent from the following description of exemplary embodiments with reference to the attached drawings.

BRIEF DESCRIPTION OF THE DRAWINGS

FIGS. 6A and 6B are typical sectional views taken along line 6-6 in FIG. 1 illustrating the support member integrated with the liquid supply member, in which FIG. 6A is a sectional view where the support member has a projected portion, and FIG. 6B is a sectional view where the support member has a depressed portion.

DESCRIPTION OF THE EMBODIMENTS

Figure 1:
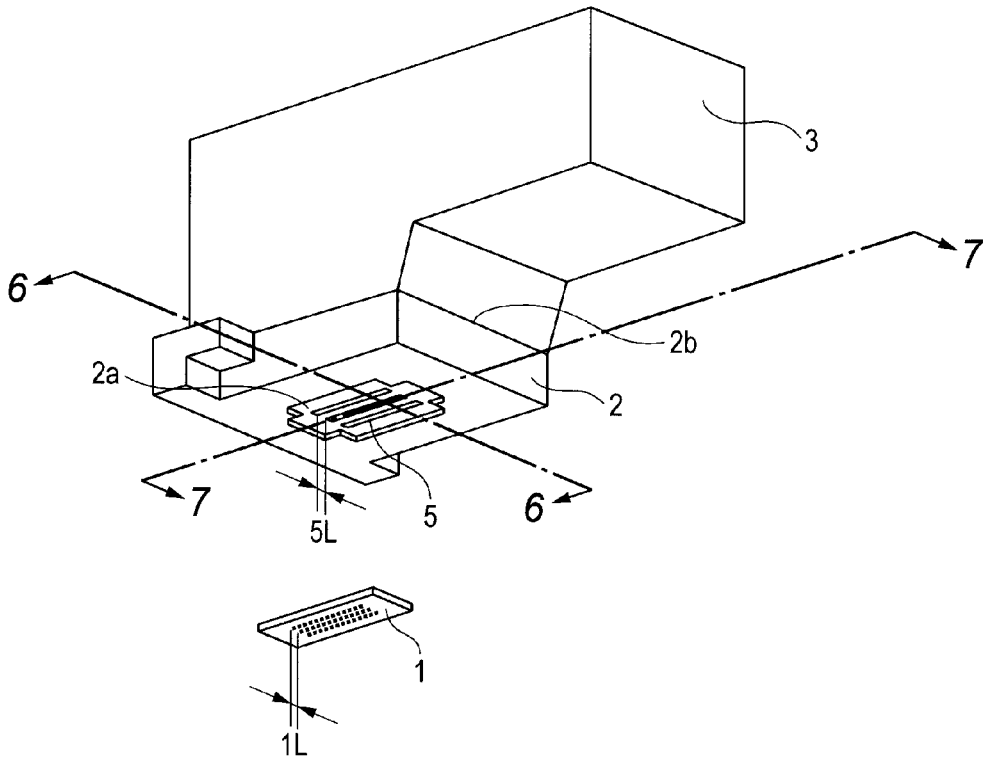
FIG. 1 is a typical view for explaining the construction of a liquid ejection head.

FIG. 1 is a typical view for explaining the construction of a liquid ejection head (for example, an ink jet recording head). As described above, an ejection device substrate 1 having an ejection orifice array composed of a plurality of ejection orifices for ejecting an ink (liquid) is narrowed. When two or more inks are ejected (three inks are ejected in FIG. 1), the spacing (indicated by, for example, reference sign 1L) between two ejection orifice arrays adjoining each other thereby mainly becomes less than 1 mm. As a result, the spacing (indicated by, for example, reference sign 5L) between two ink supply flow paths (liquid supply flow paths) 5 adjoining each other at a joint surface 2*a* with respect to a substrate 1 also becomes less than 1 mm.

Incidentally, since the joint between the ejection device substrate and the support member easily affects a recorded image, they are generally joined without dislocation at a high positional accuracy of less than 1 mm by a mounter to prevent leakage of an ink to the outside of a flow path.

On the other hand, since the joint between the support member and the ink supply member (liquid supply member) has a slight influence on a recorded image, they are integrally molded as a simple method. However, when the spacing between two ink supply flow paths adjoining each other at a joint surface 2*b* between the support member and the ink supply member is less than 1 mm, packing may not be sufficiently conducted in some cases depending on molding conditions even when integral molding is conducted, so that joint failure may be caused in some cases. Thus, reliability of liquid sealability by the joint has heretofore been improved by providing a depressed and projected engagement portion in a joint region between the support member and the ink supply member. However, when the spacing between the two ink supply flow paths adjoining each other is less than 1 mm, a blocking wall of a depressed and projected profile effective for liquid sealability may not be provided in some cases.

Under such circumstances, in the present invention, the spacing between two ink supply flow paths adjoining each other at a joint surface 2*b* of the support member with respect to the ink supply member is made larger than the spacing between the two ink supply flow paths at a joint surface 2*a* of the support member with respect to the ejection device substrate, whereby the blocking wall of the depressed and projected profile can be easily formed in the joint region between the support member and the ink supply member.

The present invention will hereinafter be described in detail.

The liquid ejection head according to the present invention can be used as an ejection head for inks, chemical liquids, adhesives and solder pastes. Description will hereinafter be given paying attention to an ink jet recording head ejecting an ink among liquid ejection heads.

The ink jet recording head has an ejection device substrate 1, a support member 2 and an ink supply member 3.

The ejection device substrate has a substrate provided with an energy-generating element for generating energy for ejecting an ink. In addition, the ejection device substrate may have an ejection orifice for ejecting an ink, a flow path communicating with the ejection orifice and a supply port communicating with this flow path and supplying the ink to the flow path.

The support member 2 is provided between the ejection device substrate 1 and the ink supply member 3 and has two or more ink supply flow paths (indicated by reference sign 5 in FIG. 1) that are through-holes extending through the support member for supplying the ink from the ink supply member to the ejection device substrate. These ink supply flow paths may be caused to communicate with the supply port of the ejection device substrate.

The ink supply member 3 may have a flow path composed of a through-hole (indicated by reference sign 3*b* in FIG. 6B) communicating with the ink supply flow path that the support member 2 has and extending through the ink supply member 3 and a supply chamber (indicated by reference sign 3*a* in FIG. 6B) communicating with this through-hole, with respect to each ink supply flow path.

Figure 2A:
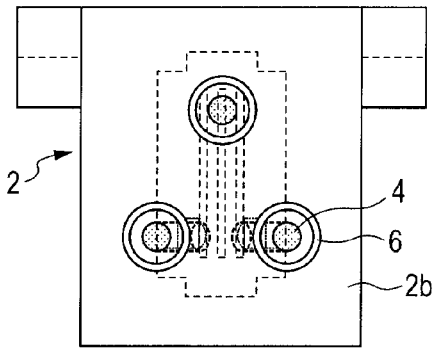
FIGS. 2A and 2B are typical plan views of a support member for explaining a liquid supply flow path and a depressed and projected profile at a joint surface with respect to a liquid supply member.
Figure 2B:
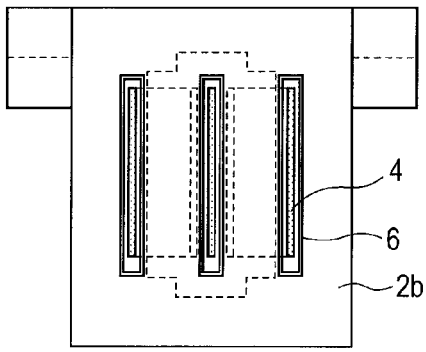

Incidentally, as illustrated in FIG. 1, FIG. 2A and FIG. 2B, the ink supply flow path at the joint surface 2*a* between the support member 2 and the ejection device substrate 1 is indicated by reference sign 5, and the ink supply flow path at the joint surface 2*b* between the support member 2 and the ink supply member 3 is indicated by reference sign 4. Description will hereinafter be given paying attention to the support member and the ink supply member.

Figure 3A:
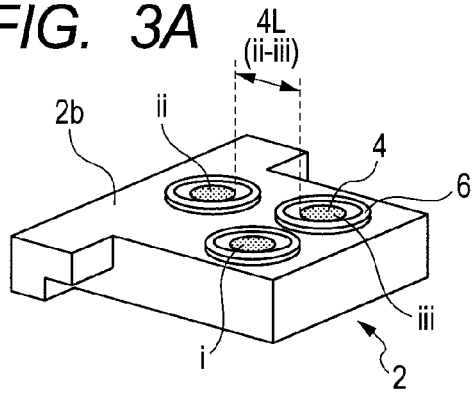
FIGS. 3A, 3B, 3C, 3D and 3E are typical perspective views for explaining a liquid supply flow path and a depressed and projected profile at a joint surface with respect to the liquid supply member.

FIGS. 2A and 2B and FIGS. 3A to 3E are typical plan views and typical perspective views, respectively, of the support member 2 for explaining the ink supply flow path and a depressed and projected profile at the joint surface 2*b*. The support members illustrated in FIGS. 3A to 3E each have three ink supply flow paths (i, ii and iii) whose opening form is quadrangular at the joint surface 2*a* and circular at the joint surface 2*b*. FIG. 2A is a plan view of the support member illustrated in FIG. 3A, and FIG. 2B is a plan view of a support member having ink supply flow paths whose opening form is quadrangular at both joint surfaces 2*a* and 2*b*. As described above, the opening form of the ink supply flow path at each joint surface may be selected as needed. For example, the opening form may be made elliptical or quadrangular as illustrated in FIG. 1 in addition to the circle.

Incidentally, in the present invention, the blocking wall of the depressed and projected profile may be provided in the joint region between the support member and the ink supply member as described above for the purpose of making a spacing 4L between ink supply flow paths adjoining each other at the joint surface 2*b* large compared with a spacing 5L at the joint surface 2*a*. Therefore, in the present invention, a support member having a projected portion or a depressed portion at the joint surface 2*b* is used from the viewpoint of liquid sealability. This projected portion or depressed portion may be provided between two ink supply flow paths adjoining each other. Incidentally, the depressed or projected portion is most favorably provided so as to surround each ink supply flow path for improving the blocking ability of the depressed or projected portion. By doing so, a plurality of blocking walls may be provided between the adjoining ink supply flow paths.

On the other hand, in the ink supply member, a projected or depressed profile corresponding to the depressed and projected profile formed in the support member is formed at the joint surface with respect to the support member. Incidentally, the support member and the ink supply member may also have both depressed portion and projected portion at the joint surface 2*b*.

Figure 3B:
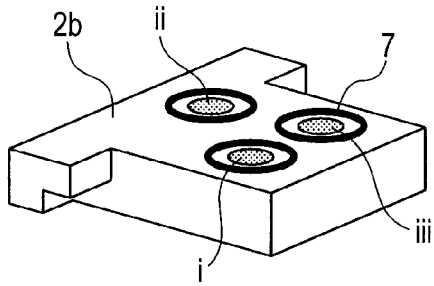

In FIG. 3A, a projected blocking wall 6 of a circular form concentric with the ink supply flow path 4 is arranged so as to surround each ink supply flow path 4, and in FIG. 3B, a depressed blocking wall 7 of a circular form concentric with the ink supply flow path 4 is arranged so as to surround each ink supply flow path 4.

Figure 3C:
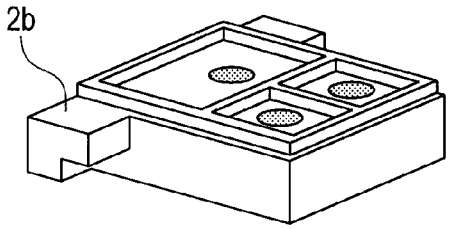
Figure 3D:
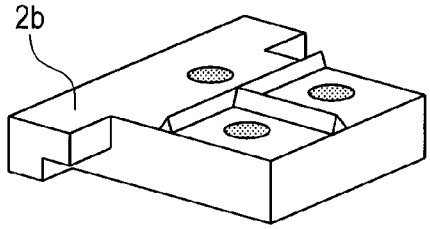
Figure 3E:
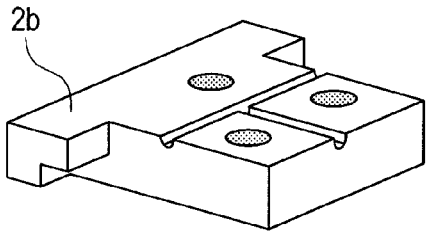
Figure 4A:
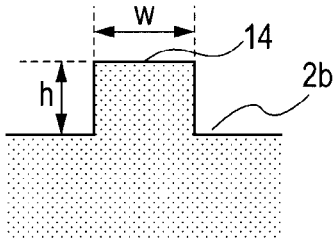
FIGS. 4A, 4B and 4C are typical views illustrating examples of a projected portion of the support member formed at the joint surface with respect to the liquid supply member.
Figure 4B:
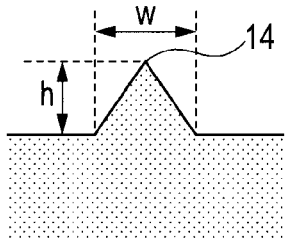
Figure 4C:
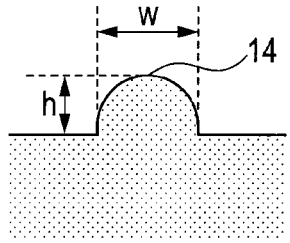

In FIG. 3C, a quadrangular projected blocking wall surrounding each ink supply flow path 4 is arranged at the joint surface 2*b*. In FIGS. 3D and 3E, a projected portion or a depressed portion is arranged at the joint surface 2*b* so as to partition two ink supply flow paths adjoining each other though each ink supply flow path is not surrounded thereby.

FIGS. 4A to 4C, and FIGS. 5A to 5C are sectional views of projected and depressed portions provided at the joint surface 2*b* when the support member has been cut perpendicularly to the support member. The sectional forms of the projected and depressed portions may be selected as needed. For example, as illustrated in FIGS. 4A to 4C, and FIGS. 5A to 5C, a top (upper portion) 14 of the projected portion and a bottom of the depressed portion may be in a flat form, acute form or round form.

No particular limitation is imposed on the width w of the projected portion so far as the projected portion is held in the support member. However, the width is favorably controlled to 1 mm or more and 3 mm or less. The height h of the projected portion is also favorably controlled to 1 mm or more and 3 mm or less. When they are 1 mm or more, molding is easy, while releasability becomes excellent when they are 3 mm or less.

Figure 5A:
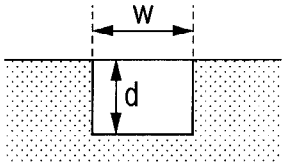
FIGS. 5A, 5B and 5C are typical views illustrating examples of a depressed portion of the support member formed at the joint surface with respect to the liquid supply member.
Figure 5B:
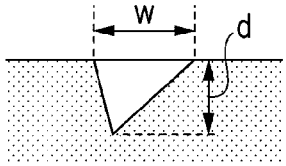
Figure 5C:
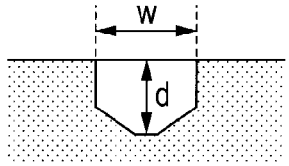

The width w and depth d of the depressed portions illustrated in FIGS. 5A to 5C are also favorably controlled to 1 mm or more and 3 mm or less for the same reasons as described above.

Figure 6A:
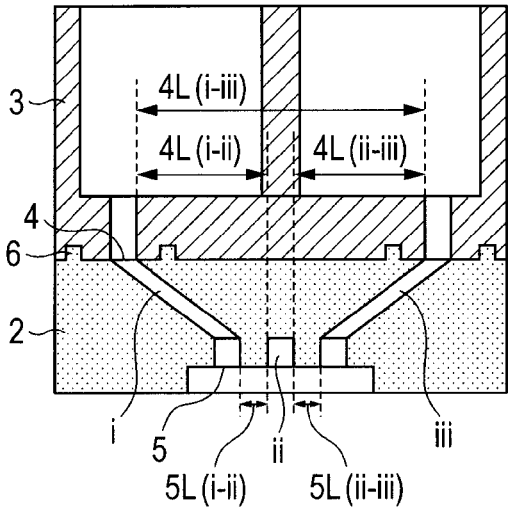
Figure 6B:
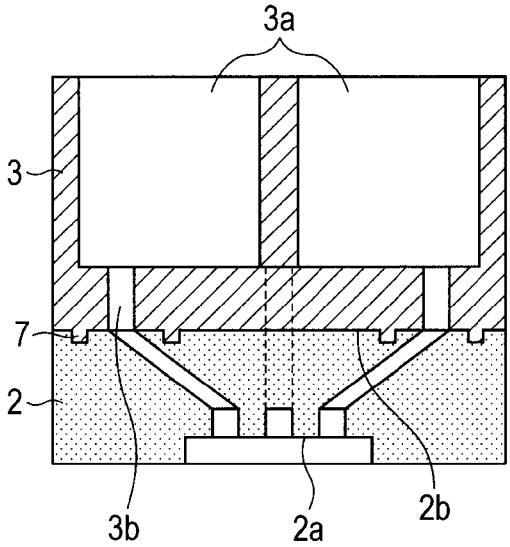
Figure 7:
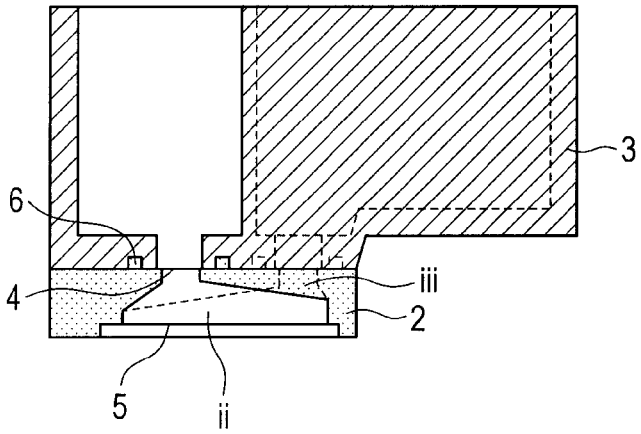
FIG. 7 is a typical sectional view taken along line 7-7 in FIG. 1 illustrating the support member integrated with the liquid supply member.

FIGS. 6A and 6B are sectional views taken along line 6-6 in FIG. 1, in which FIG. 6A illustrates the support member 2 integrated with the ink supply member 3 as illustrated in FIG. 3A, and FIG. 6B illustrates the support member 2 integrated with the ink supply member 3 as illustrated in FIG. 3B. FIG. 7 is a sectional view taken along line 7-7 in FIG. 1 illustrating the support member 2 integrated with the liquid supply member 3 as illustrated in FIG. 3A.

In the present invention, the spacings 4L between two ink supply flow paths adjoining each other at the joint surface 2*b* are all larger than any spacing 5L at the joint surface 2*a*. In short, in FIGS. 6A and 6B, the spacings 4L(i-ii), 4L(ii-iii) and 4L(i-iii) are all larger than the spacing 5L(i-ii) and than the spacing 5L(ii-iii).

Incidentally, the ink supply flow paths i and iii do not adjoin each other at the joint surface 2*a* as illustrated in FIG. 1, so that a spacing 5L(i-iii) does not exist. The spacing 4L(i-ii) indicates a spacing between the ink supply flow paths i and ii at the joint surface 2*b*, and the spacing 5L(i-ii) indicates a spacing between the ink supply flow paths i and ii at the joint surface 2*a*. Incidentally, the spacing between two ink supply flow paths adjoining each other means a distance between these two ink supply flow paths.

In FIG. 6A, the spacing 4L(ii-iii) does not illustrate a spacing between the flow paths ii and iii at a sectional surface taken along line 7-7 in FIG. 1, but illustrates the spacing 4L(ii-iii) illustrated in FIG. 3A. The same applies to the spacing 4L(i-ii) in FIG. 6A. As illustrated in FIG. 3A, the three ink supply flow paths are arranged at equal intervals at the joint surface 2*b*, so that all the spacings 4L(i-ii), 4L(ii-iii) and 4L(i-iii) illustrated in FIG. 6A become an equal spacing (distance). Since the three ink supply flow paths are also arranged at equal intervals at the joint surface 2*a* as illustrated in FIG. 1, both spacings 5L(i-ii) and 5L(ii-iii) in FIG. 6A become an equal spacing.

When the spacing 4L at the joint surface 2*b* is larger than the spacing 5L at the joint surface 2*a*, the number of combinations of adjoining ink supply flow paths may be different between the joint surface 2*a* (two combinations in FIGS. 6A and 6B) and the joint surface 2*b* (three combinations in FIGS. 6A and 6B) or may be the same. In the present invention, the ink supply flow path may have any form in the interior of the support member. For example, a spacing between two ink supply flow paths adjoining each other may be made gradually large from the joint surface 2*a* toward the joint surface 2*b*, or a fixed (unchanged) spacing portion may exist from the joint surface 2*a* toward the joint surface 2*b* in the spacing between the two ink supply flow paths adjoining each other as illustrated in FIGS. 6A and 6B.

A resin used in the support member 2 will now be described.

The support member is desired to have heat resistance against heat generated from the ejection device substrate in addition to liquid contact property. Thus, examples of a resin material for imparting the heat resistance to the support member may include polystyrene, PPS (poly(phenylene sulfide)), acrylic resins, HIPS (high impact polystyrene), PP (polypropylene), PE (polyethylene), nylon and PSF (polysulfone). In particular, PPS resin (poly(phenylene sulfide) resins) are favorable because molding can be easily conducted even when a filler capable of lowering a coefficient of linear expansion is contained therein in plenty.

In the present invention, the support member can be formed cheaper by using a polymer alloy than by using one kind of a high functional material having several properties such as heat resistance, joining ability to the ink supply member and liquid contact property at the same time. Therefore, the support member is favorably formed by using a polymer alloy of the above-described resin material imparting the heat resistance and a material high in compatibility with the ink supply member. In particular, since the ink supply member is formed with a first resin which will be described subsequently, the same resin as the first resin forming the ink supply member is favorably used as the material high in compatibility with the ink supply member.

The support member may also be formed with a material containing a polymer alloy that is a mixture of the first resin forming the ink supply member and a second resin (for example, the above-described resin material imparting the heat resistance) different from the first resin. An alloy of the first resin and a metal such as magnesium may also be used as the polymer alloy used in the support member.

Incidentally, a polyethylene-based copolymer in which an epoxy compound is copolymerized may also be contained in the support member for more improving the compatibility with the ink supply member.

A filler may also be added into the support member, thereby easily lowering the coefficient of linear expansion of the support member. As the filler, a material capable of lowering the coefficient of linear expansion of a resin, such as glass filler, carbon filler, spherical silica, spherical alumina, mica or talc, which is an inorganic filler, may be used.

When the filler is added into the support material, a spherical filler that is spherical particles is favorably used from the viewpoint of surface smoothness and the viewpoint of causing no anisotropy on expansion coefficient. In addition, since the coefficient of linear expansion of the ejection device substrate (silicon substrate) generally used in the liquid ejection head is $0.3\times10^{-5}$ (1/K), the addition amount of the filler is favorably increased for getting the coefficient of linear expansion of the support member close to that value.

Thus, two or more fillers different in particle size are favorably used in combination. Rate of voids can be easily lowered by repeatedly filling interspaces among large particles with small particles. As a result, the filling rate can be easily heightened. For example, when a filler of the combination of 75 to 85% by mass of a spherical filler having an average particle size of 30 μm and 15 to 25% by mass of a spherical filler having an average particle size of 6 μm is used, high-density filling becomes easily feasible.

The content of the filler in the support member is favorably 90% by mass or less though it varies according to the resin material used. When the content is 90% by mass or less, it is easily prevented that kneading becomes difficult, and pelletizing can be easily conducted.

The content of the filler in the support material is more favorably 70% by mass or more and 85% by mass or less. When the filler is contained in the support member at this proportion, the coefficient of linear expansion of the support member is easily lowered, and a difference in coefficient of expansion from that of the ejection device substrate can be easily lessened. In addition, when PPS is used in the support member in a proportion of favorably 3.8 parts by mass or more, more favorably 5.0 parts by mass or more, to 100 parts by mass of the filler, the flowability upon molding of the support material becomes very good.

The resin (first resin) used in the formation of the ink supply member 3 will now be described.

As the first resin used in the formation of the ink supply member, modified PPE (poly(phenylene ether)), PS (polystyrene), HIPS (high impact polystyrene) or PET (polyethylene terephthalate) may be used. Taking liquid contact property, dimensional stability upon molding and rigidity into consideration, modified PPE (poly(phenylene ether)) is favorable.

In addition, the ink supply member 3 may also contain another resin than the above-described resin. However, it may be better in some cases not to contain another resin. For example, when a resin material used as another resin is assumed to cause difficulty in molding details of the ink supply member with good accuracy, it is better not to contain such a material in the ink supply member.

In the present invention, it is favorable to integrally mold the ink supply member and the support member by using modified PPE for the ink supply member in particular and using a polymer alloy (containing a spherical filler and/or a polyethylene-based copolymer copolymerized with an epoxy compound as needed) containing PPS and modified PPE for the support member. A support member that fulfills the role of a support member supporting the substrate and is high in compatibility with the ink supply member can thereby easily be obtained. In addition, an integrally molded product of this support member and the ink supply member that are joined with good compatibility can be easily obtained. For example, the support member may be an injection-molded product of an alloy material (polymer alloy) containing PPS, PPE and a spherical filler.

It is favorable to use modified PPE for the support member at a proportion of 2 parts by mass or more to 100 parts by mass of the filler because the joining ability to the ink supply member 3 can be improved. No particular limitation is imposed on the upper limits of the contents of the PPS and modified PPE used in the support member. However, contents that are not lower than the lower limits of respective amounts necessary for satisfying flowability upon molding of the support member, linear expansibility of the support member and joining ability to the ink supply member 3 are favorable. Accordingly, the contents of the PPS and modified PPE are each favorably 40 parts by mass or less per 100 parts by mass of the filler from the balance with other materials.

Figure 8:
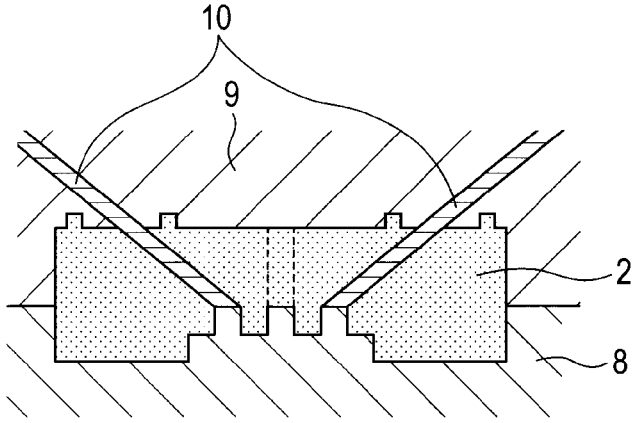
FIG. 8 is a typical sectional view for explaining molding of the support member.

The support member used in the present invention can be produced by, for example, the following process. A material of the support member is first kneaded to form pellets. At this time, when the material of the support member contains 75% by mass or more of a filler, a kneader capable of applying strong shear force is favorably used. For example, when an open roll continuous extruder "KNEADEX" (trade name, manufactured by Mitsui Mining Co., Ltd.) is used as the kneader, the material of the support material is fed to this device, whereby kneading and pelletizing can be continuously conducted. The pellets are then injected into a mold (cavity plate 8; core 9) having a slide 10 with a predetermined form as illustrated in FIG. 8 by a molding machine, whereby the support member can be produced by injection molding. At this time, when the content of the filler in the material of the support member is high, and so flowability of the material is low, a high speed and high pressure molding machine capable of injecting the material of the support member at a high speed may be used. In an ordinary molding machine, its injection speed is about 500 mm/sec, while an injection speed of 1,500 to 2,000 mm/sec is achieved in the high speed and high pressure molding machine. With respect to molding conditions, it is favorable that the injection speed and the injection pressure are controlled to 1,000 mm/sec or more and 300 MPa or more, respectively, to improve the packing.

Since the support member and the ink supply member can be produced by a simple device, these members are favorably integrated by insert molding which will be described subsequently. In addition, the support member and the ink supply member may be integrated by a welding method using heat, vibration or ultrasonic waves.

Figure 9A:
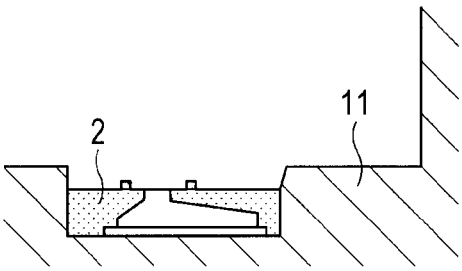
FIGS. 9A and 9B are typical sectional views for explaining integral molding of the support member and the liquid supply member.
Figure 9B:
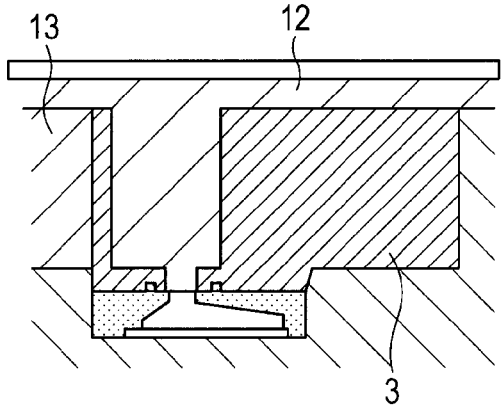

Integral joint of the support member and the ink supply member by molding will now be described with reference to FIGS. 9A and 9B. FIGS. 9A and 9B illustrate molding procedures. In a state where the support member 2 has been installed in and fixed to a mold cavity plate 11 of the ink supply member 3 as illustrated in FIG. 9A, a material for forming the ink supply member 3 is first injection-molded by means of a mold (core 12; slide 13). At this time, a joint surface between the ink supply member 3 and the support member 2 is fused as illustrated in FIG. 9B, whereby the support member 2 and the ink supply member 3 that have been joined to each other as illustrated in FIG. 7 can be obtained. This molding method is an integrally molding method generally called insert molding, and the support member 2 can be surely joined to the ink supply member 3 by this method.

The support member obtained by the above-described method and integrated with the ink supply member is joined to a desired ejection device substrate, whereby an ink jet recording head can be efficiently produced with good reproducibility. Incidentally, as a method for joining the above-described support member to the ejection device substrate, a joining method using an adhesive may be used, for example.

Example 1

A support member integrated with an ink supply member was prepared in the following manner.

A support member having a projected portion 6 illustrated in FIG. 3A and three ink supply flow paths (i, ii and iii) was first prepared in the following manner.

As materials of the support member, were provided PPS (product of TOSOH CORPORATION, trade name: SUSTEEL B-060P), modified PPE (product of SABIC Co., trade name: SE-1X) and spherical silica (product of MICRON Co., Ltd., trade name: S-430) having an average particle size of 30 μm. These materials were then kneaded in a ratio of 8/2/90 (PPS/modified-PPE/spherical-silica) in terms of mass ratio at a resin temperature of 280 to 290° C. and pelletized to obtain a polymer alloy containing the spherical filler.

This polymer alloy was used to mold the support member having the projected portion 6 surrounding the periphery of each ink supply flow path at a joint surface 2*b* with respect to an ink supply member as illustrated in FIG. 3A under the following conditions. More specifically, injection was conducted under conditions of an injection speed of 1,500 mm/sec, an injection pressure of 343 MPa, a resin temperature of 320° C., a mold temperature of 100° C. and a cooling time of 60 seconds.

Spacings between the respective ink supply flow paths of the resultant support member at a joint surface 2*a* with respect to an ejection device substrate which will be described subsequently were all 0.5 mm, and spacings between the respective ink supply flow paths at the joint surface 2*b* with respect to the ink supply member were all 12 mm. The height h of each projected portion formed at the joint surface 2*b* was 3 mm, and the width w thereof was also 3 mm.

The resultant support member was then inserted into a mold for the ink supply member in advance, and a modified PPE (product of SABIC Inc., trade name: SE-1X) resin was injected therein to conduct insert molding. The molding of the ink supply member was conducted under conditions of an injection speed of 70 mm/sec, an injection pressure of 65 MPa, a resin temperature of 320° C. and a mold temperature of 100° C.

In this manner, a molded product in which the support member and the ink supply member are integrated, whose section is illustrated in FIG. 6A, was obtained. A test for liquid sealability was performed on this molded product by a method described below to evaluate it.

A desired ejection device substrate is joined to this molded product, whereby an ink jet recording head can be prepared. Thus, an ejection device substrate 1 having an Si substrate in which a flow path forming member having an ejection orifice and a flow path communicating with the ejection orifice has been formed was provided, and a surface on the side of the Si substrate opposed to a side of an ejection orifice face of the ejection device substrate was bonded to the surface 2*a* of the support member with an adhesive. A recording head was obtained in this manner. Incidentally, the ejection device substrate had a width of 1.5 mm, a length of 19.06 mm and a thickness of 0.3 mm.

The flatness of a surface on the side where the ejection orifices are arrayed of the ejection device substrate bonded to the support member was measured by a laser three-dimensional measuring machine and found to be 20 μm. Incidentally, the flatness is determined by conducting height measurement on the surface of the ejection device substrate and finding a difference between the highest point and the lowest point.

In order to confirm warpage or distortion of the ejection device substrate, this recording head was heated for 1 hour at 100° C. and then allowed to cool, and the flatness was measured again. As a result, the flatness remained to be 20 μm. Thus, the recording head in which the ejection device substrate without warpage and distortion was installed could be obtained.

The coefficient of linear expansion of the support member was $1.4\times10^{-5}$ (1/K) as determined according to JIS K 7197.

Example 2

A support member having a depressed portion 7 illustrated in FIG. 3B and three ink supply flow paths was prepared. Specifically, as materials of the support member, modified PPE (product of SABIC Co., trade name: SE-1X) and spherical silica (product of MICRON Co., Ltd., trade name: S-430) were first provided. These materials were kneaded at a ratio of 25/75 (modified PPE/spherical silica) in terms of mass ratio and pelletized.

This pelletized material was used to mold the support member having the depressed portion 7 surrounding the periphery of each ink supply flow path as illustrated in FIG. 3B at a joint surface 2*b* with respect to an ink supply member under the following conditions. More specifically, injection was conducted under conditions of an injection speed of 1,500 mm/sec, an injection pressure of 340 MPa, a resin temperature of 300° C., a mold temperature of 80° C. and a cooling time of 60 seconds.

Spacings between adjoining ink supply flow paths of the resultant support member at a joint surface 2*a* with respect to an ejection device substrate were all 0.5 mm, and spacings between adjoining ink supply flow paths at the joint surface 2*b* with respect to the ink supply member were all 12 mm. The depth d of each depressed portion formed at the joint surface 2*b* was 1 mm, and the width w thereof was also 1 mm.

The resultant support member was then subjected to insert molding by the same method as described in Example 1 to obtain a molded product with the support member and the ink supply member integrated, whose section is illustrated in FIG. 6B.

Example 3

A support member having a projected portion and three ink supply flow paths as illustrated in FIG. 3D was prepared. As materials of the support member, PC (polycarbonate, product of Mitsubishi Engineering-Plastics Corporation, trade name: Iupilon) and spherical silica (product of MICRON Co., Ltd., trade name: S-430) were first provided. These materials were kneaded at a ratio of 25/75 (PC/spherical-silica) in terms of mass ratio and pelletized.

This pelletized material was used to mold the support member having the projected portion 7 separating two ink supply flow paths adjoining each other as illustrated in FIG. 3D at a joint surface 2*b* with respect to an ink supply member under the following conditions. More specifically, injection was conducted under conditions of an injection speed of 1,500 mm/sec, an injection pressure of 340 MPa, a resin temperature of 300° C., a mold temperature of 100° C. and a cooling time of 60 seconds.

Spacings between adjoining ink supply flow paths of the resultant support member at a joint surface 2*a* with respect to an ejection device substrate were all 0.5 mm, and spacings between adjoining ink supply flow paths at the joint surface 2*b* with respect to the ink supply member were all 12 mm. The height h of each projected portion formed at the joint surface 2*b* was 2 mm, and the width w thereof was 2 mm.

The resultant support member was then subjected to insert molding by the same method as described in Example 1 to obtain a molded product with the support member and the ink supply member integrated.

Comparative Example 1

A support member having three ink supply flow paths and having neither a depressed portion nor a projected portion at a joint surface 2*b* was prepared. Incidentally, the form of the three ink supply flow paths is the same as in Example 1. As materials of the support member, PC (polycarbonate, product of Mitsubishi Engineering-Plastics Corporation, trade name: Iupilon) and spherical silica (product of MICRON Co., Ltd., trade name: S-430) were first provided. These materials were kneaded at a ratio of 25/75 (PC/spherical silica) in terms of mass ratio and pelletized.

This pelletized material was injected under conditions of an injection speed of 1,500 mm/sec, an injection pressure of 340 MPa, a resin temperature of 300° C., a mold temperature of 100° C. and a cooling time of 60 seconds to obtain the support member. Spacings between adjoining ink supply flow paths of the resultant support member at a joint surface 2*a* with respect to an ejection device substrate were all 0.5 mm, and spacings between adjoining ink supply flow paths at a joint surface 2*b* with respect to an ink supply member were all 12 mm, and the joint surfaces 2*a* and 2*b* were both flat.

The resultant support member was then subjected to insert molding by the same method as described in Example 1 to obtain a molded product with the support member and the ink supply member integrated.

Comparative Example 2

A molded product with the support member and the ink supply member integrated was obtained in the same manner as in Example 2 except that in the form of the support member, spacings between adjoining ink supply flow paths at a joint surface 2*a* with respect to an ejection device substrate were all 0.5 mm, and spacings between adjoining ink supply flow paths at a joint surface 2*b* with respect to an ink supply member were also all 0.5 mm.

Submerging Test:

The molded products with the support member and the ink supply member integrated that were prepared in Examples 1 to 3 and Comparative Examples 1 and 2 were tested on liquid sealability.

The ink supply flow paths 5 of each support member at the joint surface 2*a* with respect to the ejection device substrate were closed with an adhesive, and a tube for supplying air was connected to the ink supply member. This sample was submerged in water, air was supplied at a pressure of 0.2 to 0.5 MPa through the tube connected to the ink supply member, and this state was held for 30 seconds. Incidentally, the joint between the support member and the ink supply member was insufficient at the pressure of 0.2 MPa in Comparative Examples 1 and 2, so that the test at the pressure of 0.5 MPa was not conducted. Evaluated results are shown in Tables 1 and 2.

Evaluation Criteria:

Good: Leakage of air in water was not visually observed, and so the joint between the support member and the ink supply member was good;

Poor: Leakage of air in water was visually observed, and so the joint between the support member and the ink supply member was insufficient.

TABLE 1

| | | Example 1 | Example 2 | Example 3 |
|---|---|---|---|---|
| Separating wall | | Projected portion Height/width 3 mm/3 mm | Depressed portion Height/width 1 mm/1 mm | Projected portion Height/width 2 mm/2 mm |
| Support member (resin material) | | PPS/modified PPE/spherical silica 8/2/90 | Modified PPE/spherical silica 25/75 | PC/spherical silica 25/75 |
| Submerging test | 0.5 MPa | Good | Good | Poor |
| | 0.2 MPa | Good | Good | Good |

TABLE 2

| | | Comp. Example 1 | Comp. Example 2 |
|---|---|---|---|
| Separating wall | | Not provided — | Not provided — |
| Support member (resin material) | | PC/spherical silica 25/75 | Modified PPE/spherical silica 25/75 |
| Submerging test | 0.5 MPa | — | — |
| | 0.2 MPa | Poor | Poor |

According to the present invention, there can be provided a liquid ejection head having good liquid sealability, such as an ink jet recording head, in which a support member supporting an ejection device substrate and an ink supply member for supplying an ink to the ejection device substrate are joined with extremely good compatibility, even when the substrate narrowing technology is advanced.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-060935, filed Mar. 18, 2011, which is hereby incorporated by reference herein in its entirety.

What is claimed is:

1. A liquid ejection head comprising an ejection device substrate having a substrate provided with an energy-generating element that generates energy for ejecting a liquid, a liquid supply member that supplies the liquid to the ejection device substrate, and a support member that is provided between the ejection device substrate and the liquid supply member and joined to the ejection device substrate and to the liquid supply member, wherein the support member has at least two liquid supply flow paths that are through-holes extending through the support member and has a projected portion or a depressed portion at a joint surface of the support member with respect to the liquid supply member, wherein a spacing between two first openings of two of the liquid supply flow paths adjoining each other at the joint surface of the support member with respect to the liquid supply member is larger than a spacing between two second openings of the two of the liquid supply flow paths adjoining each other at a joint surface of the support member with respect to the ejection device substrate, and wherein each of the two liquid supply flow paths is formed in the support member such that the first opening of the liquid supply flow path at the joint surface of the support member with respect to the liquid supply member and the second opening of the liquid supply flow path at the joint surface of the support member with respect to the ejection device substrate communicate with each other.

2. The liquid ejection head according to claim 1, wherein the projected portion or depressed portion of the support member is arranged so as to surround each of the liquid supply flow paths.

3. The liquid ejection head according to claim 1, wherein the height and width of the projected portion are both 1 mm or more and 3 mm or less, and wherein the depth and width of the depressed portion are both 1 mm or more and 3 mm or less.

4. The liquid ejection head according to claim 1, wherein the support member is an injection-molded product of an alloy material containing a spherical filler, a poly(phenylene sulfide) resin (PPS) and a modified poly(phenylene ether) resin (PPE), and the support member and the liquid supply member are integrated by insert molding.

5. The liquid ejection head according to claim 1, wherein the support member has the projected portion at a joint surface of the support member with respect to the liquid supply member.

6. The liquid ejection head according to claim 5, wherein the support member and the projected portion are formed of the same type of material.

7. The liquid ejection head according to claim 5, wherein the support member and the projected portion are formed of the same resin material.

8. The liquid ejection head according to claim 1, wherein the two liquid supply flow paths extend obliquely with respect to the joint surface of the support member with respect to the liquid supply member and the joint surface of the support member with respect to the ejection device substrate.

9. The liquid ejection head according to claim 1, wherein the support member has the depressed portion at a joint surface of the support member with respect to the liquid supply member.

* * * * *